US005406376A

United States Patent [19]

Maiwald et al.

[11] Patent Number: 5,406,376

[45] Date of Patent: Apr. 11, 1995

[54] APPARATUS FOR TESTING END PORTIONS OF ROD-SHAPED ARTICLES OF THE TOBACCO PROCESSING INDUSTRY

[75] Inventors: Berthold Maiwald, Schwarzenbek; Uwe Heitmann, Hamburg, both of Germany

[73] Assignee: Körber AG, Hamburg, Germany

[21] Appl. No.: 9,090

[22] Filed: Jan. 26, 1993

[30] Foreign Application Priority Data

Jan. 30, 1992 [DE] Germany ..... 42 02 570
Apr. 7, 1992 [DE] Germany ..... 42 11 582

[51] Int. Cl.[6] ..... G01N 21/89

[52] U.S. Cl. ..... 356/237; 209/535; 209/536; 250/223 R

[58] Field of Search ..... 356/237; 250/221.1, 250/223 R; 209/535, 536

[56] References Cited

U.S. PATENT DOCUMENTS

| | | | |
|---|---|---|---|
| 3,555,287 | 1/1971 | Schmermund | 356/445 X |
| 3,729,636 | 4/1973 | Merker | 250/223 R |
| 3,812,349 | 5/1974 | Gugliotta et al. | 356/237 X |
| 3,951,267 | 4/1976 | Reuland | 209/73 |
| 4,090,794 | 5/1978 | Benini | 356/237 X |
| 4,376,484 | 3/1983 | Seragnoli | 209/535 |
| 4,907,607 | 3/1990 | Focke et al. | 250/223 R X |
| 4,944,314 | 7/1990 | Bolt | 250/223 R X |
| 4,955,948 | 9/1990 | Focke et al. | 209/536 |
| 4,969,551 | 11/1990 | Heitmann et al. | 198/384 |
| 5,000,323 | 3/1991 | Cahill et al. | 250/223 R X |
| 5,010,904 | 4/1991 | Lassiter | 250/223 R X |

FOREIGN PATENT DOCUMENTS

| | | |
|---|---|---|
| 0080069 | 6/1983 | European Pat. Off. . |
| 462690 | 10/1968 | Switzerland . |
| 2176598 | 12/1986 | United Kingdom . |

*Primary Examiner*—Vincent P. McGraw
*Attorney, Agent, or Firm*—Darby & Darby

[57] ABSTRACT

Apparatus for testing the end portions of cigarettes to detect end portions containing insufficient quantities of tobacco has a conveyor which transports the cigarettes sideways past at least two testing stations each of which accommodates a discrete capacitive and/or photoelectronic testing unit. Repeated monitoring of the end portions of successive cigarettes reduces the likelihood that unsatisfactory cigarettes, particularly cigarettes with end portions which are empty or contain insufficient quantities of tobacco particles, would reach the consumers. Signals which are generated by the testing units can be used to segregate cigarettes having defective end portions.

40 Claims, 3 Drawing Sheets

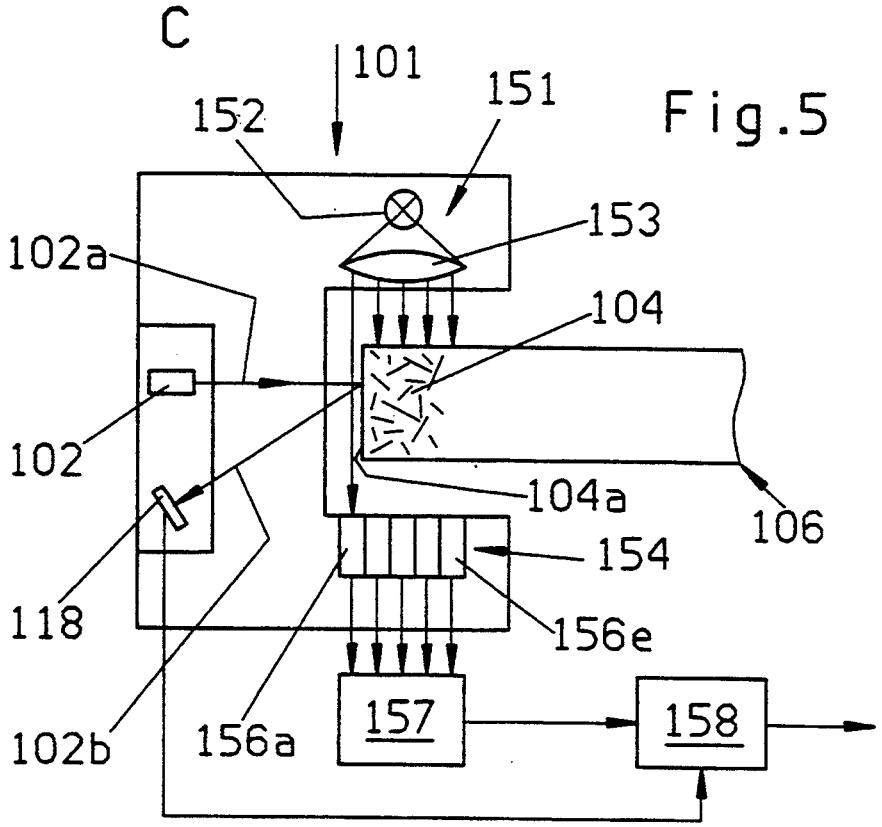
Fig.5
Fig.6
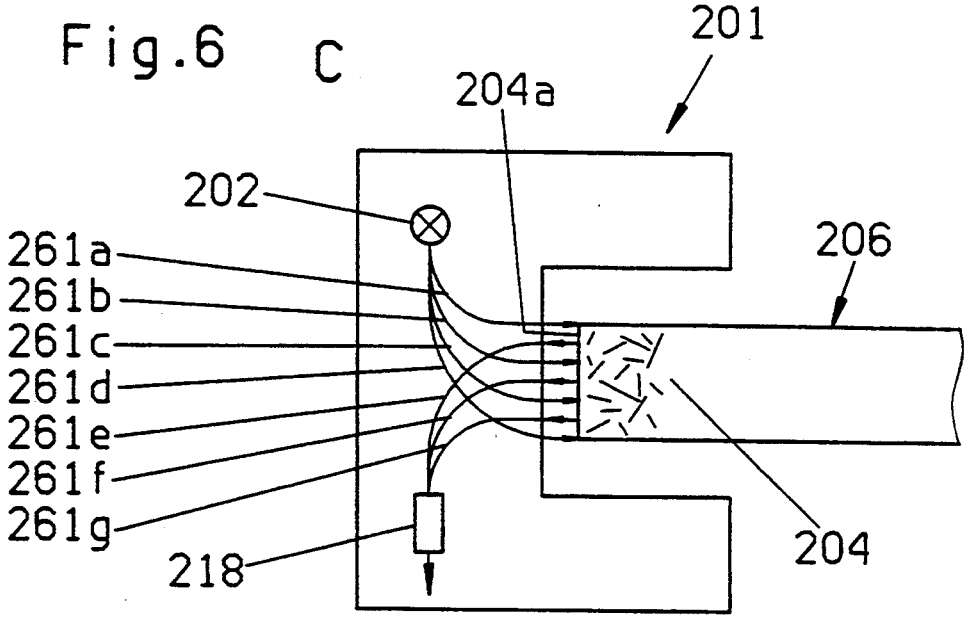

APPARATUS FOR TESTING END PORTIONS OF ROD-SHAPED ARTICLES OF THE TOBACCO PROCESSING INDUSTRY

BACKGROUND OF THE INVENTION

The invention relates to the testing of cigarettes or other rod-shaped articles of the tobacco processing industry (hereinafter called cigarettes or filter cigarettes for short), and more particularly to improvements in apparatus for testing the end portions of cigarettes. Still more particularly, the invention relates to improvements in apparatus which can be utilized with advantage to detect cigarettes wherein the end portions contain unsatisfactory (especially insufficient) quantities of tobacco and/or other fibrous material.

Commonly owned U.S. Pat. No. 3,951,267 (granted Apr. 20, 1976 to Joachim Reuland for "Apparatus for testing the end portions of cigarettes or the like") discloses an apparatus which is used to determine the mass of tobacco shreds in the end portions of rod-like tobacco filters or filter cigarettes. The patented apparatus employs a conveyor which transports a succession of cigarettes sideways in order to advance the end portions of fillers of successive cigarettes between or past two electrodes forming part of a capacitor which is in circuit with a source of high-frequency voltage. The source establishes a high-frequency field in the path of successive end portions so that the end portions influence the field to an extent which is indicative of the mass of tobacco in the thus tested ends. The influence of successive end portions upon the field is evaluated by a circuit which generates signals serving to segregate cigarettes with fillers having defective ends. The patented apparatus can be used for the testing of all kinds of rod-shaped articles of the tobacco processing industry including plain or filter tipped cigarettes, cigars or cigarillos as well as filter rod sections of the type used in filter tipping machines for the production of filter cigarettes or like rod-shaped articles. In comparison with mechanical testing apparatus which employ pins or other components designed to penetrate into or to bear against the tobacco particles at the ends of cigarettes, the patented apparatus exhibits the advantage that it need not employ moving parts in order to carry out the actual testing operation. This enables the patented apparatus to test rod-shaped articles of the tobacco processing industry at the rate at which the articles are turned out by a modern high-speed production line.

OBJECTS OF THE INVENTION

An object of the invention is to provide an apparatus which can test cigarettes more accurately than heretofore known testing apparatus.

Another object of the invention is to provide an apparatus which can accurately ascertain the quantity of tobacco and/or other fibrous material in the end portions of cigarettes while the cigarettes are transported at an elevated speed.

A further object of the invention is to provide the above outlined apparatus with one or more novel and improved testing units.

An additional object of the invention is to provide the apparatus with a novel and improved photoelectronic testing unit.

Still another object of the invention is to provide an apparatus which can be installed in existing plants for mass production of cigarettes as a superior substitute for heretofore known testing apparatus.

A further object of the invention is to provide an apparatus which constitutes an improvement over and a further development of apparatus of the type disclosed in the aforediscussed U.S. Pat. No. 3,951,267 to Reuland.

Another object of the invention is to provide a novel and improved combination of testing units for use in the above outlined apparatus.

An additional object of the invention is to provide an apparatus which can test the end portions of plain or filter tipped cigarettes with a heretofore unknown degree of accuracy even if the cigarettes of a series of successive cigarettes are transported at different distances from one or more testing units.

Still another object of the invention is to provide a novel and improved method of testing the end portions of cigarettes, particularly of ascertaining the quantities of fibrous material in the end portions of cigarettes.

A further object of the invention is to provide a machine which employs one or more testing apparatus of the above outlined character.

Another object of the invention is to provide a production line which embodies one or more apparatus of the above outlined character.

SUMMARY OF THE INVENTION

One feature of the present invention resides in the provision of an apparatus for testing the end portions of rod-shaped articles of the tobacco processing industry wherein a filler of fibrous material is surrounded by a tubular wrapper. The improved apparatus comprises means (e.g., a rotary drum-shaped conveyor) for advancing rod-shaped articles in a predetermined direction along a predetermined path, a first testing unit having means for monitoring the quantity of fibrous material in the end portions of articles advancing along a first portion of the path, and at least one second testing unit having means for monitoring the quantity of fibrous material in the end portions of articles advancing along a second portion of the path. The rod-shaped articles can constitute cigarettes and the fibrous material in the tubular wrappers of such articles then contains or consists of tobacco.

At least one of the monitoring means can include means for generating signals in response to detection of end portions containing less than a predetermined quantity of fibrous material.

The first portion can be located upstream of the second portion of the path, and the first testing unit can comprise photoelectronic means for monitoring the quantity of fibrous material.

If the rod-shaped articles whose end portions are to be tested comprise radiation-penetrable wrappers (e.g., wrappers which are permeable to light), one of the monitoring means can comprise at least one source of radiation, means for directing radiation from the at least one source against an end portion of an article advancing along the respective portion of the path whereby the radiation penetrates into one side and issues from the other side of the wrapper of such end portion at a rate which is a function of the quantity of fibrous material in the end portion, and at least one photoelectronic receiver for radiation which issues from wrappers in the respective portion of the path. The at least one source can constitute a source of light. The directing means can include means for directing radiation into the end portions of articles advancing along the respective portion of the path so that the radiation is reflected by fibrous material in or at the respective end portion and penetrates through and outwardly from the respective wrapper. The at least one receiver is then outwardly adjacent the wrappers of end portions of the articles advancing along the respective portion of the path.

The at least one source can include a source of infrared light, and the directing means of such apparatus can comprise means for collimating infrared light between the at least one source and the end portions of articles advancing along the respective portion of the path. The at least one source of infrared light can include a diode. The at least one receiver is then sensitive to infrared light, and the one monitoring means preferably further comprises an optical filter which is interposed between the at least one receiver and the end portions of articles advancing along the respective portion of the path to intercept radiation other than infrared light.

The one monitoring means can comprise a plurality of receivers which are exposed to radiation issuing from different sections of the wrapper of an end portion advancing along the respective portion of the path. Such monitoring means can further comprise at least one tunnel defining a passageway for the propagation, against the at least one receiver, of radiation which has penetrated through the wrapper of an end portion in the respective portion of the path. Such at least one tunnel can comprise means for preventing entry into the passageway of radiation other than the radiation which has penetrated through the wrapper of an end portion in the respective portion of the path. A radiation-permeable filter or cover can be interposed between the at least one receiver and an end portion in the respective portion of the path. If the one monitoring means comprises a plurality of receivers, the receivers can be connected in parallel. Each such receiver has a radiation receiving input and an output for transmission of signals when the intensity of radiation at the respective input exceeds a predetermined threshold value.

One of the monitoring means can comprise a device for capacitive measurement of the quantity of fibrous material in the end portions of rod-shaped articles advancing along the respective portion of the path. Such device for capacitive measurement of the quantity of fibrous material can comprise a high-frequency resonator circuit including a capacitor serving to establish in the respective portion of the path a field which is traversed by the end portions of articles advancing along the path, and means for measuring an electrical value which is a function of the quantity of fibrous material in an end portion at the respective portion of the path. The capacitor can be of the type known as stray field or open field capacitor.

Each of the two or more testing units (or at least two or more than two testing units) can comprise photoelectronic means for monitoring the quantity of fibrous material. At least one of such photoelectronic means can include at least one source of radiation, means for directing radiation from the at least one source against the end portions advancing along the respective portion of the path whereby a characteristic of such radiation is influenced by the quantity of fibrous material in an end portion advancing along the respective portion of the path, and at least one receiver which serves to generate a signal denoting the thus influenced characteristic of radiation. The at least one radiation source can include a laser. The radiation can be reflected by the end faces of end portions of rod-shaped articles, and the radiation directing means can include means for directing radiation from the at least one source against the end face of an end portion in the respective portion of the path. The at least one receiver of such at least one monitoring means can be located in the path of radiation which is reflected by the end faces of end portions advancing along the respective portion of the path. The at least one photoelectronic means can further comprise one or more optical fibers for conveying reflected radiation from the end face of an end portion advancing along the respective portion of the path to the at least one receiver.

The advancing means of the improved apparatus can comprise a ramp, a cam or other suitable means for locating the end portion of each rod-shaped article advancing along at least one of the first and second portions of the path in a predetermined position relative to the respective testing unit. If the at least one portion of the path is the second portion, the monitoring means of the at least one second unit can comprise a device for capacitive measurement of the quantity of fibrous material in the end portions advancing along the second portion of the path.

The monitoring means at one of the aforementioned portions of the path can be spaced apart from the end portions of rod-shaped articles advancing along the one portion of the path, and such apparatus can further comprise means for generating signals denoting the spacing or distance of end portions from the monitoring means at the one portion of the path. For example, the one portion can be the second portion of the path, and at least the first testing unit can comprise photoelectronic means for monitoring the quantity of fibrous material.

Another feature of the invention resides in the provision of an apparatus for testing the end portions of rod-shaped articles of the tobacco processing industry wherein a filler of fibrous material is surrounded by a tubular wrapper, particularly for detecting articles having end portions containing unsatisfactory (insufficient) quantities of fibrous material. The apparatus comprises means for advancing rod-shaped articles in a predetermined direction along a predetermined path, and a testing unit having photoelectronic means for monitoring the quantity of fibrous material in the end portions of articles advancing along a predetermined portion of the path. The testing unit includes at least one source of infrared radiation (such at least one source preferably includes a diode), means for directing radiation from the at least one source against the end portions of rod-shaped articles advancing along the predetermined portion of the path so that the thus directed radiation penetrates through the wrappers at the end portions of rod-shaped articles at a rate which is indicative of the quantity of fibrous material in such end portions, and photoelectronic receiver means for radiation which has penetrated through the wrappers of end portions of rod-shaped articles advancing along the predetermined portion of the path. The directing means preferably comprises means for collimating radiation between the at least one source and the end portions of rod-shaped articles advancing along the predetermined portion of the path.

The receiver means can comprise one or more photodiodes which are sensitive to infrared radiation.

If the at least one source emits infrared light, the testing unit preferably further comprises an optical filter which is interposed between the receiver means and the end portions of rod-shaped articles advancing along the predetermined portion of the path to intercept radiation other than infrared light.

The receiver means can comprise a plurality of discrete receivers which are exposed to radiation issuing from different sections of the wrapper of an end portion advancing along the predetermined portion of the path.

The testing unit can further comprise at least one tunnel which defines a passageway for the propagation, against the receiver means, of radiation which has penetrated through the wrapper of an end portion forming part of a rod-shaped article advancing along the predetermined portion of the path. The at least one tunnel can comprise means for preventing entry into the passageway of radiation other than that which has issued from the at least one source and has penetrated through the wrapper of an end portion advancing along the predetermined portion of the path. The receiver means of such apparatus preferably comprises at least one photodiode.

The testing unit can further comprise a radiation-permeable filter or cover between the receiver means and the end portion of a rod-shaped article advancing along the predetermined portion of the path.

If the receiver means comprises a plurality of discrete receivers, such receivers can be connected in parallel and their outputs are designed to transmit signals when the intensity of radiation reaching the inputs of the respective discrete receivers exceeds a predetermined threshold value.

The apparatus can further comprise a second testing unit having means for monitoring the quantity of fibrous material in the end portions of rod-shaped articles advancing along a second portion of the path. Such second portion can be located upstream or downstream of the predetermined portion. The monitoring means of the second testing unit can comprise a device for capacitive measurement of the quantity of fibrous material in the end portions of rod-shaped articles advancing along the second portion of the path. Alternatively, the second testing unit can comprise photoelectronic means for monitoring the quantity of fibrous material.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

BRIEF DESCRIPTION OF THE DRAWINGS

FIG. 5 is a schematic view of a photoelectronic testing unit which constitutes a modification of the photoelectronic unit shown in FIGS. 1 and 2; and FIG. 6 illustrates certain details of a photoelectronic testing unit constituting a modification of the unit which is shown in FIG. 5.

DESCRIPTION OF PREFERRED EMBODIMENTS

Figure 1:
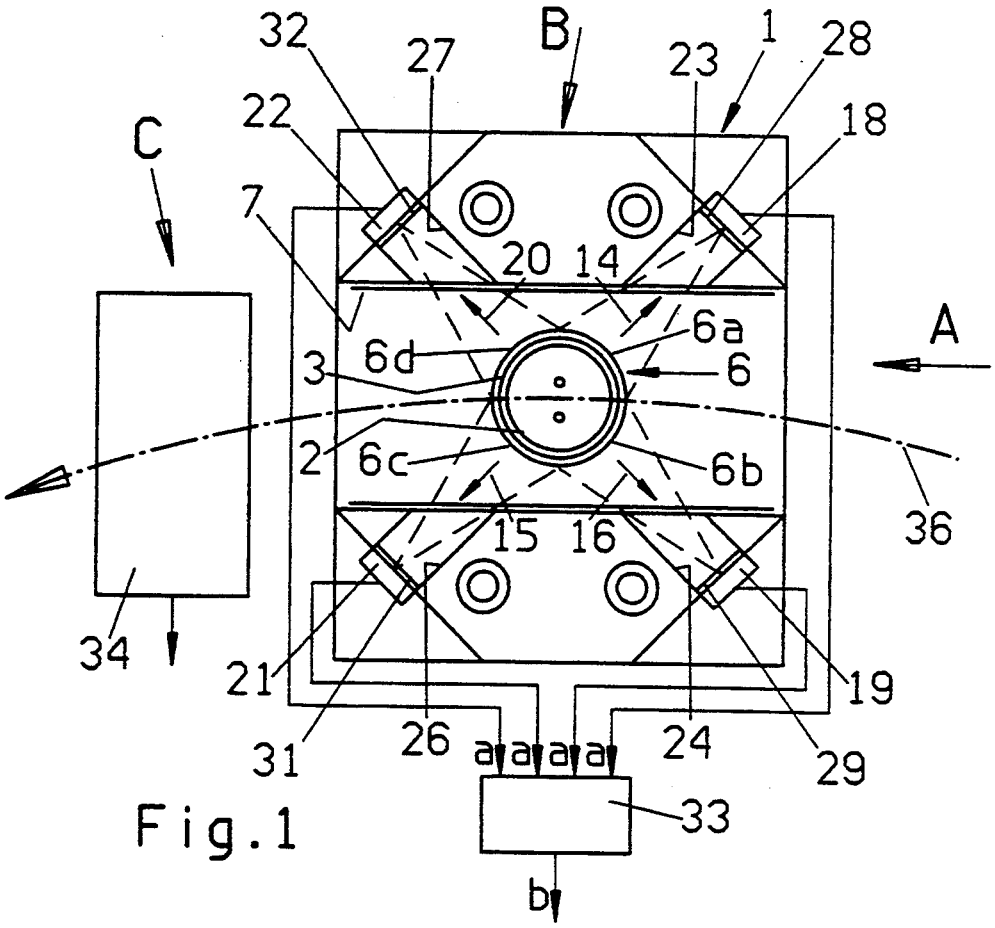
FIG. 1 is a fragmentary schematic front elevational view of a testing apparatus with a photoelectronic testing unit and a capacitive testing unit.
Figure 2:
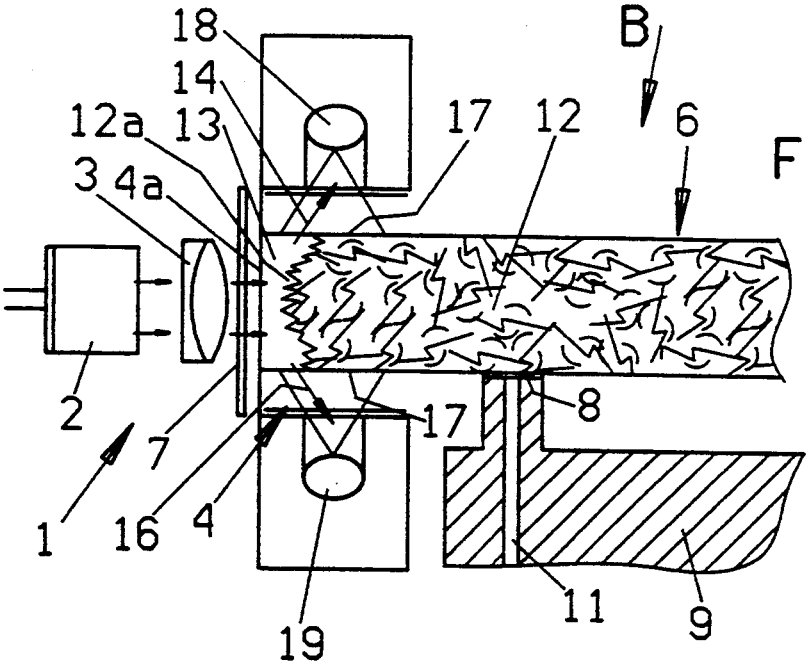
FIG. 2 is a fragmentary partly side elevational view of the apparatus of FIG. 1, with the second testing unit omitted and with the article advancing means and an article shown in section.

FIGS. 1 and 2 illustrate a portion of a testing apparatus which embodies one form of the present invention and comprises an endless conveyor 9 (e.g., a rotary drum) serving as a means for advancing a series of successive equidistant rod-shaped articles 6 (such as filter cigarettes or plain cigarettes) along an endless arcuate path 36 having a first portion B for a first testing unit 1 and a second portion C for a second testing unit 34. The portion B is located upstream of the portion C, as viewed in the direction (arrow A) of advancement of cigarettes 6 along their path 36. The manner in which the cigarettes 6 are fed into successive receiving means 8 (e.g., axially parallel peripheral flutes) of the conveyor 9 ahead of the path portion B and/or the manner in which twice-tested cigarettes 6 are evacuated from successive flutes 8 downstream of the path portion C is not shown because it is well known and forms no part of the present invention. Reference may be had, for example, to the aforementioned U.S. Pat. No. 3,951,267 to Reuland. The means for attracting the cigarettes 6 to the surfaces surrounding the respective flutes 8 includes a suction generating device, not shown, and suction ports 11 (one shown in FIG. 1) which are provided in the conveyor 9 and are communicatively connected with the suction generating device during advancement of cigarettes 6 from the locus of admission ahead of the path portion B to the locus of evacuation or expulsion downstream of the path portion C.

The testing unit 1 at the first testing station (adjacent the path portion B) includes photoelectronic means for ascertaining the quantity of fibrous material (such as tobacco particles or filter material for tobacco smoke) in the end portions 4 of successive cigarettes 6. FIGS. 1 and 2 show two testing units 1, 34 each of which is positioned to test one end portion 4 of each cigarette 6. However, the machine in which the testing apparatus of FIGS. 1 and 2 is installed can comprise a second testing apparatus for the other end portions of successive cigarettes 6, e.g., if the cigarettes are plain cigarettes.

The photoelectronic means of the testing unit 1 comprises a radiation source 2, e.g., a diode which is constructed to emit high-intensity light in the infrared range of the spectrum, and means 3 for directing radiation from the source 2 against the end portions 4 of successive cigarettes 6 advancing along the portion B of the endless path 36. The illustrated radiation directing means 3 includes a collimating lens which directs parallel beams of infrared light from the diode 2 against the end faces 4a of successive end portions 4 so that the beams impinge upon the adjacent end portions of rod-like fillers 12 within the tubular wrappers 17 of the respective cigarettes 6. A radiation-transmitting filter or cover 7 (e.g., a plate of glass or other light-transmitting material) is interposed between the lens 3 and the end faces 4a of the adjacent end portions 4 to constitute a partition between the cigarettes 6 on the one hand and the radiation emitting and radiation directing components 2, 3 of the photoelectronic monitoring means of the testing unit 1 on the other hand. The purpose of the radiation transmitting cover 7 is to prevent rapid contamination of the rather sensitive lens 3 by (at least slightly adhesive) fragments of tobacco particles, minute fragments of cigarette paper or tipping paper (wrappers 17) and/or other impurities which could affect the intensity of radiation impinging upon the end portion of the filler 12 advancing along the path portion B.

The flutes 8 of the conveyor 9 are normally closely adjacent each other, and the conveyor 9 is driven at an elevated speed so that the apparatus of FIGS. 1 and 2 tests large numbers of cigarettes per unit of time. A modern high-speed cigarette maker can turn out up to and well in excess of 10,000 cigarettes per minute.

FIG. 2 shows that the illustrated end portion 4 of the cigarette 6 is defective in that the end portion of the wrapper 17 is inadequately filled with tobacco particles of the filler 12. In fact, the end portion of the wrapper 17 immediately adjacent the end face 4a is empty so that parallel beams of radiation which issue from the lens 3 impinge upon the irregularly configurated recessed end face 12*a* of the filler 12 and are reflected and/or otherwise deflected by the tobacco particles at the end face 12*a* toward the inner side of the radiation-penetrable wrapper 17. The rate at which the radiation issues at the outer side of the wrapper 17 (namely of that portion of the wrapper which forms part of the end portion 4) is indicative of the quantity of fibrous material in the end portion 4. The end portion of the filler 12 which is shown in FIG. 2 is quite defective, i.e., the end portion 4 of the cigarette 6 contains a quantity of tobacco particles which is well below the optimum quantity; therefore, the total amount of radiation which has impinged upon the internal surface of the end portion of the wrapper 17 and has penetrated through and outwardly beyond the wrapper suffices to warrant the generation of one or more signals which can be processed to segregate the cigarette 6 of FIG. 2 from satisfactory cigarettes. The reference character 13 denotes in FIG. 2 the empty portion of the end portion of the wrapper 17 at the end portion 4 of the cigarette 6. The directions of propagation of radiation which has penetrated through the end portion of the wrapper 17 during testing of the quantity of fibrous material in the path portion B are indicated by arrows 14, 15, 16 and 20 (only the arrows 14 and 16 can be seen in FIG. 2). Each of the arrows 14, 15, 16 and 20 is indicative of radiation which penetrates through one of four equal sections or segments 6*a*, 6*b*, 6*c*, 6*d* of the cigarette 6 advancing along the station which accommodates the testing unit 1. Each of the sections 6*a* to 6*d* is assumed to extend along an arc of 90° as considered in the circumferential direction of the respective wrapper 17.

The intensity of radiation which propagates itself in the directions of arrows 14, 15, 16 and 20 (i.e., the extent of illumination from the interior of the respective arcuate sections of the end portion of the wrapper 17 at the station for the testing unit 1) is ascertained by four discrete photoelectronic receivers or transducers 18, 19, 21 and 22 which are outwardly adjacent the end portions 4 advancing along the portion B of the path 36. The preferably symmetrical distribution of the receivers 18, 19, 21 and 22 (each of which can constitute a photodiode that is sensitive to infrared light) can be seen in FIG. 1; the receivers 18, 22 are located at the outer side and the receivers 19, 21 are located at the inner side of the path portion B.

Each of the four receivers is disposed at the remote end of a channel defined by a discrete tunnel 23, 24, 26, 27. The surfaces bounding the channels of the tunnels 23, 24, 26, 27 constitute means (or portions of means) for preventing undesirable radiation (such as daylight or artificial light) from reaching the photosensitive surfaces of the respective receivers 18, 19, 21, 22. The filtering or intercepting action of the surfaces bounding the channels of the tunnels 23, 24, 26, 27 is assisted (or vice versa) by four optical filters 28, 29, 31, 32 which are installed in front of the respective tunnels 23, 24, 26 and 27. All that counts is to ensure that the receivers are exposed exclusively to infrared light which has issued from the diode 2 and has passed through the wrapper 17 of a cigarette 6 advancing along the path portion B, or to reduce to a minimum the quantity of unwanted radiation which reaches the receivers. This enhances the accuracy of the testing operation. Such accuracy can be enhanced still further by increasing the number of photoelectronic receivers, tunnels and optical filters. It is further within the purview of the invention to reduce the number of photoelectronic receivers to less than four.

Each channel can constitute a straight bore or hole which is drilled into or is otherwise formed in the respective tunnel.

It is presently preferred to install and design the receivers 18, 19, 21 and 22 in such a way that the areas which are scanned thereby partially overlap, i.e., that the tunnel 23 in front of the receiver 18 can receive radiation which has penetrated through the section 6a (arrow 14) as well as some radiation which has passed through the sections 6*b* and 6*d* (arrows 16 and 20), that the tunnel 24 in front of the receiver 19 can receive radiation which has penetrated through the section 6*b* (arrow 16) as well as some radiation which has passed through the neighboring parts of the sections 6*a* and 6*c* (arrows 14 and 15), and so forth. This ensures that the composite photoelectronic receiver means of the testing unit 1 is exposed to all of the radiation which has been emitted by the diode 2 and has passed from the space 13 through the wrapper 17 and into the tunnels 23, 24, 26 and 27.

The inputs of the diodes constituting the receivers 18, 19, 21 and 22 are located at the remote or outer ends of the respective tunnels 23, 24, 26 and 27. The outputs a of these receivers transmit signals to the corresponding inputs of a threshold circuit 33 of any known design. The circuit 33 is preferably constructed in such a way that its output b transmits a signal to a suitable ejecting device (e.g., a pneumatic ejector employing a nozzle which is connectable to a source of compressed gas) whenever at least one of the outputs a transmits a signal whose intensity or another characteristic exceeds a predetermined threshold value denoting that the end portion 4 advancing along the path portion B contains less than an acceptable quantity of tobacco particles. Thus, the receivers 18, 19, 21, 22 operate in parallel. The quantity of tobacco particles in the end portion 4 of the cigarette 6 which is shown in FIG. 2 is so low that the outputs a of all four receivers 18, 19, 21, 22 transmit to the threshold circuit 33 "defect" signals which are processed to initiate the expulsion of the respective cigarette 6 from the adjacent flute 8 or from a conveyor (not shown) which receives randomly distributed satisfactory and defective cigarettes 6 from the path 36 downstream of the path portion C.

In accordance with a feature of the invention, the quantity of tobacco particles in the end portions 4 of successive cigarettes 6 is tested twice, once in the path portion B and thereupon by the capacitive monitoring means of the second testing unit 34 at the testing station which is adjacent the path portion C, i.e., downstream of the path portion B as seen in the direction of arrow A denoting the direction of advancement of cigarettes 6 along the path 36. Though the second testing unit 34 is shown as being located downstream of the testing unit 1, it is equally within the purview of the invention to install the unit 34 upstream of the unit 1 or to simply interchange the positions of these units so that the unit 34 is located at the path portion B and the unit 1 is located at the path portion C.

The purpose of the testing unit 34 is to detect cigarettes 6 having defective end portions 4 (i.e., end portions containing unsatisfactory (normally insufficient) quantities of tobacco particles. The main purpose of the testing unit 34 (or any other testing unit which is used in combination with the testing unit 1) is to detect defective end portions 4 which happened to advance beyond the path portion B without causing the generation of one or more signals denoting that the respective cigarette 6 must be segregated from cigarettes having satisfactory end portions 4. Analogously, the testing unit 1 will normally (or, for all practical purposes, invariably) detect defective end portions 4 which will not be detected by the testing unit 34 if the sequence of installing the units 1, 34 adjacent the path 36 corresponds to that shown in FIG. 1. It has been found that, by utilizing more than a single testing unit, the improved apparatus practically invariably ensures detection of all end portions 4 wherein the fillers contain unsatisfactory quantities of fibrous material.

Figure 3:
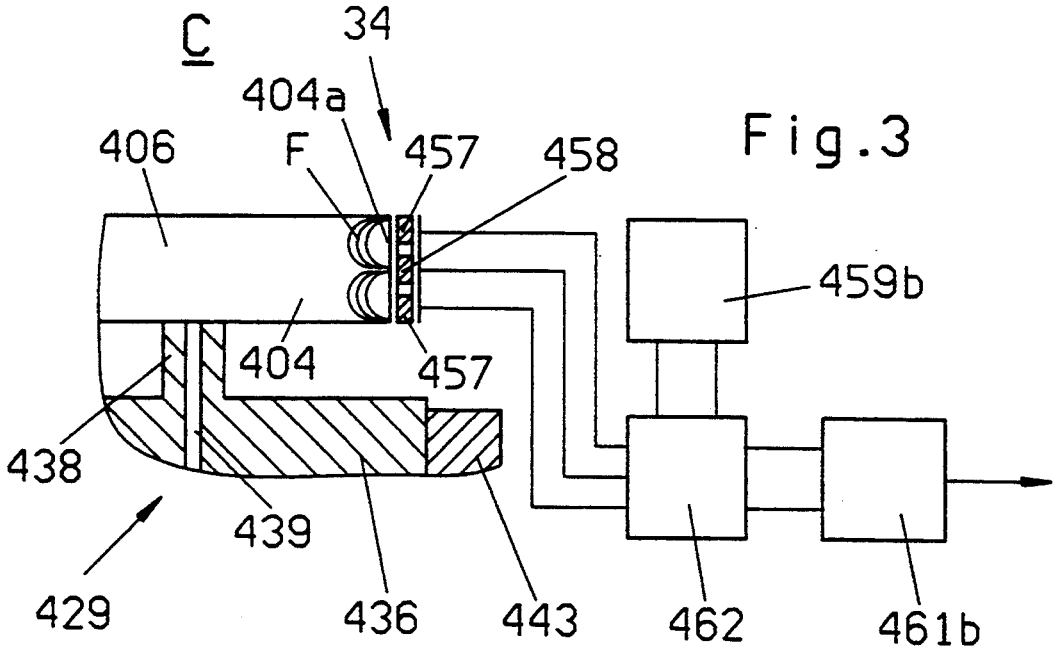
FIG. 3 is a schematic view of a capacitive testing unit which can be utilized in the apparatus of the present invention.
Figure 4:
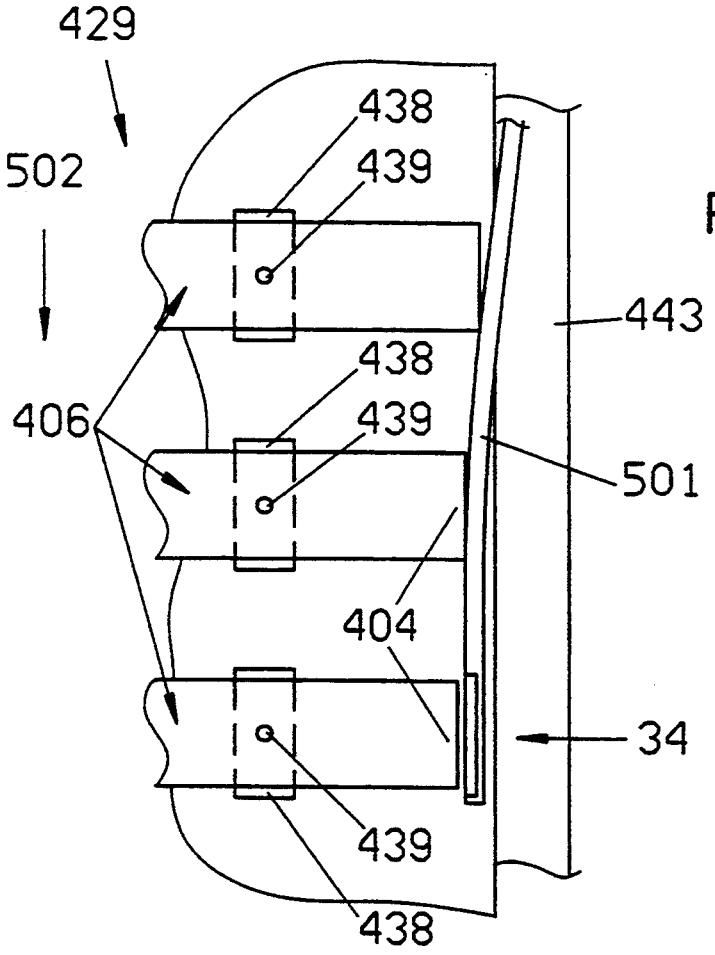
FIG. 4 is a schematic plan view of certain parts of the testing unit which is shown in FIG. 3.

FIGS. 3 and 4 illustrate certain details of the testing unit 34. The body 436 of a rotary drum-shaped conveyor 429 is provided with flutes 438 for cigarettes 406 having end portions 404 which are to be tested to ascertain the quantity of fibrous material therein. The flutes 438 are provided with suction ports 439 serving the same purpose and being used in the same way as described in connection with the suction port 11 of the flute 8 shown in FIG. 2. A ring-shaped valve plate 443 performs the same function as the similarly referenced valve plate shown in FIG. 7 of U.S. Pat. No. 3,951,267 to Reuland. In fact, the structure shown in FIGS. 3 and 4 is substantially identical with that shown in FIG. 6 of the patent to Reuland. The capacitor of the testing unit 34 comprises annular electrodes 457,458 and a stationary ramp 501 is provided to push or shift the end portions 404 of successive cigarettes 406 in the path portion C to optimum positions relative to the field F which is established by the electrodes. The conveyor 429 advances the cigarettes 406 sideways in the direction of arrow 502 whereby the sloping surface of the ramp 501 gently shifts the end portions 404 in the axial direction of the conveyor. The pressure in the suction ports 439 is not well below atmospheric pressure so that the ramp 501 can shift the cigarettes 406 along their respective flutes 438 without damaging the wrappers of such cigarettes. As can be seen in FIG. 3, the end face **404*a* of the end portion 404 of a cigarette 406 advancing along the path portion C is immediately or very closely adjacent the electrodes 457, 458 so that the fibrous material (if any) in the end portion 404 traverses the field F. The testing unit 34 further comprises a source 459*b* of high-frequency voltage which is in circuit with the electrodes 457, 458, i.e., with the frequency determining component of the electrical resonance circuit. A quartz crystal (not specifically shown) is provided to stabilize the frequency of voltage which is applied to the electrodes. The unit 34 further comprises an evaluating circuit 461*b* whose output transmits signals denoting the mass of tobacco particles in the end portions 404 of successive cigarettes 406. The circuit 461*b* determines the amplitude of a parameter (such as current or potential) of the resonance circuit 462 which is influenced by the mass of tobacco particles advancing across the field F while the end portion 404 of a cigarette 406 is being transported along the path portion C. Reference may be had to the patent to Reuland for a more detailed description of the capacitive testing unit 34. FIG. 6 of the patent to Reuland illustrates the manner in which signals from the evaluating circuit 461*b* are processed to initiate the ejection of defective cigarettes 406, namely of cigarettes wherein the end portions 404 contain unsatisfactory quantities of fibrous material. The means for ejecting defective cigarettes can comprise a solenoid-operated valve or another suitable valve which expels defective cigarettes from their flutes, either on the conveyor 429 or on a conveyor which is located downstream of the conveyor 429. A single ejector can be used to expel defective cigarettes which are detected by the testing unit 1 and/or by the testing unit 34**.

FIG. 5 illustrates a portion of a modified photoelectronic testing unit 101 which can be used in lieu of the testing unit 34 of FIGS. 1 and 3–4 or in lieu of the testing unit 1 of FIGS. 1–2. It is assumed that the testing unit 101 replaces the unit 34 at the portion C of the path 36, i.e., downstream of the testing unit 1 of FIGS. 1–2.

The testing unit 101 comprises a source 102 (e.g., a laser) of radiation **102*a* which impinges upon and is reflected by the end face 104*a* of the end portion 104 of a cigarette 106 advancing along the path portion C. The beam 102*a* is reflected, as at 102*b*, and impinges upon the sensitive surface of a photoelectronic receiver 118, e.g., a photodiode whose output transmits a signal denoting the quantity of fibrous material in the tested end portion 104. The conveyor which advances a series of successive cigarettes 104 along the path portion C of FIG. 5 (i.e., past the testing unit 101**) is not specifically shown in the drawing.

The testing unit 101 of FIG. 5 can also employ a ramp 501 and/or other suitable means for locating the end portions 104 of successive cigarettes 106 at the same distance from the radiation source 102. Alternatively, or in addition to such mechanical locating means, the testing unit 101 is further equipped with a signal generating device 151 which serves as a means for detecting or monitoring the distance of an end portion 104 in the path portion C from the radiation source 102 and transmits appropriate signals to one input of a computer 158 another input of which receives signals from the optoelectronic receiver 118. The signal generating device 151 can be used when it is impractical or impossible to properly locate successive end portions 104 at a requisite distance from the radiation source 102 by mechanical or by any other means. Accurate positioning of the end portions 104 in the course of successive testing operations is desirable and advantageous in order to ensure that the signals from the receiver 118 to the computer 158 will accurately reflect the quantities of fibrous material in successively tested end portions 104. Alternatively (and this is accomplished by the provision of the signal generating device 151), it is necessary to transmit to the computer 158 signals which are indicative of the distance of the end portion 104 of a cigarette 106 advancing along the path portion C from the radiation source 102 so that eventual deviations of the monitored distance from the desired optimum or acceptable distance can be taken into consideration for the generation of signals transmitted by the computer 158 and serving to segregate unsatisfactory cigarettes 106 from acceptable cigarettes.

The illustrated signal generating device 151 comprises a radiation source 152 at one side of the path portion C, an optical element 153 (preferably a collimating lens) which directs parallel beams of radiation from the source 152 against the external surface of the wrapper forming part of the end portion 104 of a cigarette 106 advancing along the path portion C, and an array 154 of discrete photoelectronic receivers or transducers 156a to 156e adjacent the path portion C opposite the radiation source 152 and lens 153. It is clear that, in actual practice, the array 154 can be assembled of a large number (e.g., many times five) receivers 156 which can form a row extending in substantial parallelism with the axis of a cigarette advancing past the testing unit 101. The number of receivers 156 which are illuminated by radiation issuing from the lens 153 and bypassing the end portion 104 at the station for the testing unit 101 (or the number of receivers which are not illuminated by such radiation) is indicative of the distance of the end face 104*a* in the path portion C from the radiation source 102. The outputs of the receivers 156 are connected with the corresponding inputs of a standard evaluating circuit 157 whose output transmits to the computer 158 signals denoting the distance of successive end faces 104*a* from the radiation source 102. The signals from the circuit 157 are evaluated together with the corresponding signals from the receiver 118, and the thus modified or combined signals are indicative of the actual quantity of fibrous material in successive end portions 104. Signals from the output of the computer 158 can be processed in the same way as the signals from the evaluating circuit 461*b* in the capacitive testing unit 34 of FIGS. 1, 3 and 4.

An important advantage of the testing unit 101 is that its signal generating device 151 ensures accurate determination of the quantity of fibrous material in each of a short or long series of successively tested end portions 104 even though the distance of end faces 104*a* forming part of such end portions from the radiation source 102 fluctuates within a reasonably wide range, as long as such range can be encompassed or covered by the selected signal generating device 151.

FIG. 6 illustrates a portion of a testing unit 201 which can be utilized in lieu of the testing unit 1, 34 or 101, e.g., with the testing unit 1 of FIGS. 1–2 adjacent the portion C of the path 36. A cigarette 206 having an end portion 204 with an end face 204*a* is shown at the testing station (path portion C) which is occupied by the unit 201. A radiation source 202 emits radiation which is directed against the end face 204*a* by a set of fiber optical conductors including those shown at 261*a*, 261*b*, 261*c* and 261*d*. Radiation which is reflected by the end face 204*a*, and which is indicative of the quantity of fibrous material in the end portion 204, is conveyed by fiber optical conductors including those shown at 261*e*, 261*f* and 261*g*. These conductors convey reflected radiation to a photoelectronic receiver 218. The output of the receiver 218 transmits appropriate signals to an arrangement for segregation of defective cigarettes 206 (i.e., cigarettes having end portions 204 containing unsatisfactory quantities of fibrous material) from satisfactory cigarettes. It is clear that the number of fiber optical conductors leading from the radiation source 202 to the end faces 204*a* of successive articles 206 and/or from the end faces 204*a* to the receiver 218 can greatly exceed the numbers which are shown in FIG. 6.

The timing of activation of testing units 101, 201 of the type shown in FIGS. 5 and 6 is synchronized with movements of the conveyors for the articles 106 and 206 in a manner which is well known from the art of testing rod-shaped articles of the tobacco processing industry and therefore not shown in FIGS. 5 and 6. The synchronizing means is designed to transmit signals to the radiation sources 102, 152 or to the radiation source 202 when the end face 104*a* or 204*a* of an article 106 or 206 is in proper position relative to the testing unit 101 or 201.

The testing units which are shown in FIGS. 1 to 6 are merely representative of testing units which can be used in the apparatus of the present invention to carry out repeated measurements of the quantity of fibrous material in the end portions of rod-shaped articles of the tobacco processing industry. The selected testing unit or units need not necessarily employ a capacitive or photoelectronic monitoring system. Furthermore, the number of testing units can be increased to more than two without departing from the spirit of the invention. For example, the testing unit 34 at the path portion C in FIG. 1 can be followed by a testing unit 101 or 201. Alternatively, testing units 1 and 101 or 1 and 201 can be followed by a testing unit 34.

An important advantage of the improved apparatus is that it ensures highly reliable detection of all rod-shaped articles of the tobacco processing industry wherein the one and/or the other end portion contains unsatisfactory quantities of fibrous material and/or other filler material. It is often preferred to construct the apparatus in such a way that it employs at least two different testing units, e.g., a testing unit with photoelectronic monitoring means and a testing unit with capacitive monitoring means. Alternatively, the apparatus can employ two or more testing units with monitoring means whose operation is based on the same principle (e.g., capacitively or photoelectronically) but which are constructed in different ways. For example, the testing unit 1 can be used jointly with the testing unit 101 and/or 201.

The testing units 1, 101 and 201 constitute features which are believed to be novel and patentable per se. For example, the feature of the testing unit 1 that radiation is caused to penetrate through the wrapper forming part of the end portion of a rod-shaped article of the tobacco processing industry, and the intensity and/or other characteristics of such radiation are monitored subsequent to penetration through such wrapper, is deemed to constitute a patentable innovation irrespective of whether or not the corresponding testing unit (such as the unit 1 of FIGS. 1–2) is used alone or in combination with one or more identical or different testing units. A radiation source (2) in the form of a diode which emits infrared light and cooperates with a light collimating optical system (3) has been found to be particularly suitable for the practice of the present invention with one or more testing units of the type shown in FIGS. 1 and 2. The light output of a diode for emission of infrared light is rather high even though the diode is normally small or very small, e.g., it can be designed to emit a divergent radiation beam issuing from a point-shaped source, and such beam is thereupon collimated prior to impinging upon the end face of the mass of fibrous material in the end portion of a filler advancing past the testing station. The utilization of a collimating lens is desirable and advantageous on the ground that the testing operation is not affected, or is not unduly affected, by eventual fluctuations of the distance of the radiation source from the end face of an end portion being tested.

The just discussed testing unit, employing photoelectronic monitoring means including a diode for emission of infrared light and a collimating lens, preferably further employs a receiver in the form of a photodiode which is sensitive to infrared light. The optical filter or filters (such as 28, 29, 31 and 32) which are preferably used with such receiver are or can be designed to intercept radiation in the visible range of the spectrum so that the improved testing unit is not affected by stray radiation, such as daylight or light coming from any other source but the diode for emission of infrared light.

The provision of two or more receivers is desirable on the ground that such testing unit can detect and pinpoint end portions which are only partly defective, i.e., wherein the filler extends in part all the way to the respective end face but the end portion still exhibits a cavity or empty portion of the type shown at 13 in FIG. 2.

Since none of the illustrated testing units must employ mechanical testing elements, such as pins or plungers or pushers designed to move against the end faces of the end portions of successive rod-shaped articles, the testing operation can be carried out at a high frequency. Moreover, it is immaterial whether a particular testing unit is installed upstream or downstream of the other testing unit or units because the testing at a preceding station does not adversely influence the testing at the next-following station. If a ramp of the type shown at 501 in FIG. 4 is used, its slope and suction in the ports 439 can be readily selected in such a way that any shifting (if necessary) of the articles 406 at the respective testing station does not adversely influence the shape and/or other characteristics of the end portions, i.e., the testing unit 34 of FIGS. 1, 3 and 4 can be installed upstream of the testing unit 1, 101 or 201 without adversely affecting the quality of testing by the unit 1, 101 or 201.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for testing the end portions of rod-shaped articles of tobacco processing industry wherein a filler of fibrous material is surrounded by a tubular wrapper, comprising means for individually advancing successive rod-shaped articles of a series of discrete articles in a predetermined direction along a predetermined path; a first testing unit having means for monitoring the quantity of fibrous material in the end portions of successive discrete articles advancing along a first portion of said path; and at least one second testing unit having means for monitoring the quantity of fibrous material in the end portions of successive discrete articles advancing along a second portion of said path.

2. The apparatus of claim 1, wherein the articles are cigarettes and the fibrous material contains tobacco.

3. The apparatus of claim 1, wherein at least one of said monitoring means includes means for generating signals in response to detection of end portions containing less than a predetermined quantity of fibrous material.

4. The apparatus of claim 1, wherein said first portion is located upstream of said second portion of said path and said first testing unit comprises photoelectronic means for monitoring the quantity of fibrous material.

5. The apparatus of claim 1 for individually testing the end portions of successive discrete rod-shaped articles wherein a filler of fibrous material is surrounded by a radiation-penetrable wrapper, wherein one of said monitoring means comprises at least one source of radiation, means for directing radiation from said at least one source against an end portion of an article advancing along the respective portion of said path whereby the radiation penetrates into one side and issues from the other side of the wrapper of such end portion at a rate which is a function of the quantity of fibrous material in the end portion, and at least one photoelectronic receiver for radiation issuing from wrappers in the respective portion of said path.

6. The apparatus of claim 5, wherein said at least one source is a source of light.

7. The apparatus of claim 5, wherein said directing means includes means for directing radiation into the end portions of successive discrete articles advancing along the respective portion of said path so that the radiation is reflected by fibrous material in or at the respective end portion and penetrates through and outwardly from the respective wrapper, said at least one receiver being outwardly adjacent the wrappers of end portions of successive discrete articles advancing along the respective portion of said path.

8. The apparatus of claim 5, wherein said at least one source is a source of infrared light and said directing means includes means for collimating infrared light between said at least one source and the end portions of successive discrete articles advancing along the respective portion of said path.

9. The apparatus of claim 8, wherein said at least one source includes a diode.

10. The apparatus of claim 8, wherein said at least one receiver is sensitive to infrared light and said one monitoring means further comprises an optical filter interposed between said at least one receiver and the end portions of successive discrete articles advancing along the respective portion of said path to intercept radiation other than infrared light.

11. The apparatus of claim 5, wherein said one monitoring means comprises a plurality of receivers exposed to radiation issuing from different sections of the wrapper of an end portion advancing along the respective portion of said path.

12. The apparatus of claim 5, wherein said one monitoring means further comprises at least one tunnel defining a passageway for the propagation, against said at least one receiver, of radiation which has penetrated through the wrapper of an end portion in the respective portion of said path.

13. The apparatus of claim 12, wherein said at least one tunnel comprises means for preventing entry into said passageway of radiation other than that which has penetrated through the wrapper of an end portion in the respective portion of said path.

14. The apparatus of claim 5, wherein said one monitoring means further comprises a radiation-permeable cover between said at least one source and an end portion in the respective portion of said path.

15. The apparatus of claim 5, wherein said one monitoring means comprises a plurality of receivers connected in parallel and having radiation receiving inputs and outputs for transmission of signals when the intensity of radiation at the respective inputs exceeds a predetermined threshold value.

16. The apparatus of claim 1, wherein one of said monitoring means comprises a device for capacitive measurement of the quantity of fibrous material in the end portions advancing along the respective portion of said path.

17. The apparatus of claim 16, wherein said device comprises a high-frequency resonator circuit including a capacitor arranged to establish in the respective portion of said path a field which is traversed by the end portions of successive discrete articles advancing along said path, and means for measuring an electrical value which is a function of the quantity of fibrous material in an end portion at the respective portion of said path.

18. The apparatus of claim 17, wherein said capacitor is a stray field capacitor.

19. The apparatus of claim 1, wherein each of said units includes photoelectronic means for monitoring the quantity of fibrous material.

20. The apparatus of claim 19, wherein at least one of said photoelectronic means includes at least one source of radiation, means for directing radiation from said at least one source against the end portions advancing along the respective portion of said path whereby a characteristic of such radiation is influenced by the quantity of fibrous material in an end portion advancing along the respective portion of said path, and at least one receiver arranged to generate a signal denoting the thus influenced characteristic of radiation.

21. The apparatus of claim 20, wherein said at least one source includes a laser.

22. The apparatus of claim 20 for testing the end portion of successive discrete articles wherein the end portions have radiation-reflecting end faces, said directing means including means for directing radiation from said at least one source against the end face of an end portion in the respective portion of said path, said at least one receiver being located in the path of radiation which is reflected by the end faces of end portions advancing along the respective portion of said path for successive discrete rod-shaped articles.

23. The apparatus of claim 22, wherein said at least one photoelectronic means further comprises at least one optical fiber for conveying reflected radiation from the end face of an end portion advancing along the respective portion of said path to said at least one receiver.

24. The apparatus of claim 1, wherein said advancing means comprises means for locating the end portion of each discrete article advancing along at least one of said first and second portions of said path in a predetermined position relative to the respective testing unit.

25. The apparatus of claim 24, wherein said at least one portion is said second portion of said path and the monitoring means of said at least one second testing unit comprises a device for capacitive measurement of the quantity of fibrous material in the end portions advancing along the second portion of said path.

26. The apparatus of claim 1, wherein the monitoring means at one of said portions of said path is spaced apart from the end portions advancing along said one portion of said path, and further comprising means for generating signals denoting the spacing of end portions from the monitoring means at said one portion of said path.

27. The apparatus of claim 26, wherein said one portion is said second portion of said path, at least said first testing unit having photoelectronic means for monitoring the quantity of fibrous material.

28. Apparatus for testing the end portions of rod-shaped articles of the tobacco processing industry wherein a filler of fibrous material is surrounded by a tubular wrapper, particularly for detecting articles having end portions containing unsatisfactory quantities of fibrous material, comprising means for individually advancing successive rod-shaped articles of a series of discrete articles in a predetermined direction along a predetermined path; a first testing unit having photoelectronic means for monitoring the quantity of fibrous material in the end portions of successive discrete articles advancing along a first portion of said path, including at least one source of infrared radiation, said at least one source including a diode, means for directing radiation from said at least one source against the end portions of successive discrete articles advancing along said first portion of said path so that the thus directed radiation penetrates through the wrappers of the end portions at a rate which is indicative of the quantity of fibrous material in such end portions, said directing means including means for collimating radiation between said at least one source and the end portions of successive discrete rod-shaped articles, and photoelectronic receiver means for radiation which has penetrated through the wrappers of end portions advancing along said first portion of said path; and a second testing unit having means for monitoring the quantity of fibrous material in the end portions of successive discrete articles advancing along a second portion of said path.

29. The apparatus of claim 28, wherein said receiver means includes a photodiode which is sensitive to infrared radiation.

30. The apparatus of claim 28, wherein said first testing unit further comprises an optical filter interposed between said receiver means and the end portions of successive articles advancing along said first portion of said path to intercept radiation other than infrared light.

31. The apparatus of claim 28, wherein said receiver means comprises a plurality of discrete receivers exposed to radiation issuing from different sections of the wrapper of an end portion advancing along said first portion of said path.

32. The apparatus of claim 28, wherein said first testing unit further comprises at least one tunnel defining a passageway for the propagation, against said receiver means, of radiation which has penetrated through the wrapper of an end portion advancing along said portion of said path.

33. The apparatus of claim 32, wherein said at least one tunnel comprises means for preventing entry into said passageway of radiation other than that which has issued from said at least one source and has penetrated through the wrapper of an end portion in said portion of said path.

34. The apparatus of claim 33, wherein said receiver means comprises at least one photodiode.

35. The apparatus of claim 28, wherein said first testing unit further comprises a radiation-permeable cover between said at least one source and an end portion in said portion of said path.

36. The apparatus of claim 28, wherein said receiver means comprises a plurality of discrete receivers connected in parallel and having radiation receiving inputs and outputs for transmission of signals when the intensity of radiation at the respective inputs exceeds a predetermined threshold value.

37. The apparatus of claim 28, wherein said second portion is located upstream of said first portion of said path.

38. The apparatus of claim 28, wherein said second portion is disposed downstream of said first portion of said path.

39. The apparatus of claim 28, wherein the monitoring means of said second testing unit comprises a device for capacitive measurement of the quantity of fibrous material in the end portions advancing along the second portion of said path.

40. The apparatus of claim 28, wherein said second testing unit comprises photoelectronic means for monitoring the quantity of fibrous material.

* * * * *